United States Patent [19]

Boliver et al.

[11] Patent Number: 4,857,021

[45] Date of Patent: Aug. 15, 1989

[54] ELECTRICAL CONNECTOR ASSEMBLY AND METHOD FOR CONNECTING THE SAME

[75] Inventors: Vincent J. Boliver, Brookfield; Paul M. Roscizewski, Franksville; Edward L. Sankey, Fox Lake; Roy W. DeMeyer, Oconomowoc, all of Wis.

[73] Assignee: Cooper Power Systems, Inc., Houston, Tex.

[21] Appl. No.: 258,619

[22] Filed: Oct. 17, 1988

[51] Int. Cl.[4] ..... H01R 4/56

[52] U.S. Cl. ..... 439/801; 439/813; 439/921

[58] Field of Search ..... 439/181, 183–187, 439/278, 279, 281, 282, 921, 801, 813; 403/21, 22, 118

[56] References Cited

U.S. PATENT DOCUMENTS

| | | | |
|---|---|---|---|
| 3,883,208 | 5/1975 | Sankey et al. | 439/921 |
| 3,982,812 | 9/1976 | Boliver | 439/184 |
| 4,202,591 | 5/1980 | Borgstrom | 439/185 |
| 4,353,611 | 10/1982 | Siebens et al. | 339/92 R |
| 4,354,721 | 10/1982 | Luzzi | 339/94 R |
| 4,420,202 | 12/1983 | Atakkaan | 439/278 |
| 4,722,694 | 2/1988 | Makal et al. | 439/921 |
| 4,773,872 | 9/1988 | Borgstrom et al. | 439/921 |

FOREIGN PATENT DOCUMENTS

| | | | |
|---|---|---|---|
| 211741 | 2/1987 | European Pat. Off. | 439/813 |

*Primary Examiner*—Gary F. Paumen

*Attorney, Agent, or Firm*—Michael, Best and Friedrich

[57] ABSTRACT

An assembly comprising a tap plug having therein an axially fixed nut and including an externally threaded portion threaded into a cable connector lug, a bushing having therein an internally threaded bore, and a stud including an externally threaded first end threaded into the nut, and an externally threaded second end threaded into the bushing bore.

26 Claims, 4 Drawing Sheets

ELECTRICAL CONNECTOR ASSEMBLY AND METHOD FOR CONNECTING THE SAME

BACKGROUND OF THE INVENTION

The invention relates to electrical connectors and, more particularly, to arrangements for connecting insulated, conductive members such as tap plugs and bushings. Still more particularly, the invention relates to bushing, cable connector and tap plug assemblies. The invention also relates to bushing wells and inserts and to feedthrough devices.

It is known to use a T-shaped cable connector to connect a high-voltage cable and a tap plug to a bushing on an electrical apparatus. Typically, the cable connector includes a housing having therein opposed, coaxial, tapered recesses, one of which receives a complementary tapered portion of the bushing and the other of which receives a complementary tapered portion of the tap plug. The cable connector assembly also includes a lug which is connected to the high-voltage cable, which extends between the recesses, and which is connected to the bushing and to the tap plug.

In one known construction (see, for example, U.S. Pat. No. 4,354,721), the tap plug includes an externally threaded portion that threads into a bore in the lug and that has therethrough an axial bore, and the tap plug also includes an axially movable bolt which extends through the axial bore in the externally threaded portion and which threads into an internally threaded bore in the bushing.

Additionally, U.S. Pat. No. 4,353,611 discloses a bushing well construction in which a bushing insert is connected to a bushing well by a threaded coupling member. A portion of the coupling member is threaded into the bushing well, and the bushing insert is threaded onto another portion of the coupling member.

SUMMARY OF THE INVENTION

The invention provides an improved bushing, cable connector and tap plug assembly, and also provides a method and apparatus for connecting the cable connector and tap plug to the bushing.

The assembly of the invention comprises a T-shaped cable connector including a housing defining opposed, coaxial, tapered recesses. The cable connector also includes a lug which is connected to a high-voltage cable and which extends into the housing between the recesses. The assembly also comprises a bushing adapted to be connected to an electrical apparatus such as a transformer. The bushing includes a tapered outer surface complementary with one of the recesses in the cable connector, and the bushing has therein an internally threaded bore.

The assembly also comprises a loadbreak reducing tap plug. The tap plug includes an outer housing having a tapered outer surface complementary with the other recess in the cable connector. The tap plug also includes an externally threaded portion that extends from the tap plug housing and that is adapted to be threaded into an internally threaded bore in the cable connector lug.

The tap plug also includes a contact assembly which is slideably housed within the tap plug housing and which is in electrical contact with a conductive surface within the tap plug. The tap plug also includes a "free-floating" nut rotatably housed within the tap plug housing and fixed against movement axially of the tap plug housing. In the preferred embodiment, the nut is fixed against axial movement by opposed shoulders or stops within the housing. The nut includes a socket adapted to receive a wrench for rotating the nut, and the nut has therein an internally threaded bore coaxial with a bore in the externally threaded portion.

The assembly also includes a coupling member for facilitating threading of the externally threaded portion of the tap plug into the lug bore. The coupling member includes a first portion that is coaxial with the externally threaded portion of the tap plug and that has external threads substantially identical to and aligned with the threads on the externally threaded portion. The second portion of the coupling member is housed in the bore in the externally threaded portion and has therein socket means adapted to receive the tool. A shear pin extends between the externally threaded portion of the tap plug and the second portion of the coupling member for preventing rotation of the coupling member relative to the tap plug. Preferably, the shear pin breaks when the coupling member is rotated and the torque exerted on the tap plug by the connector lug, which torque acts through the shear pin to resist rotation of the coupling member, reaches the desired level.

The assembly also comprises a stud including an externally threaded first end adapted to be threaded into the nut, and an externally threaded second end adapted to be threaded into the bushing bore.

The tap plug and cable connector are preferably connected to the bushing as follows. First, the second end of the stud is threaded into the bushing bore. Next, the wrench is used to thread the first portion of the coupling member and then the externally threaded portion of the tap plug into the lug bore. When the torque exerted on the tap plug by the cable connector lug reaches the desired level, the shear pin breaks and the coupling member is removed from the externally threaded portion of the tap plug and from the cable connector housing.

Next, the cable connector housing is placed over the bushing so that the first end of the stud extends into the bore in the externally threaded portion of the tap plug. Next, the wrench is used to rotate the nut and thereby thread the nut onto the first end of the stud until the bushing engages the lug.

The cable connector and tap plug are disconnected from the bushing by rotating the nut in the opposite direction. Since the externally threaded portion of the tap plug remains threaded into the lug and the nut is fixed against movement axially of the tap plug, rotation of the nut causes both the tap plug and the cable connector to back off the bushing and the stud.

The invention also provides a bushing well insert and a feedthrough device utilizing the above-described free-floating unit.

A principal feature of the invention is the provision of means for easily connecting a tap plug and a cable connector to a bushing. More particularly, the invention provides a connector system that is truly operable by a single operator. This is because, during connection, the threads of the nut and stud engage before interface interference is met. During disconnection, both the cable connector and tap plug are backed off the bushing because the nut is caged within the tap plug. This facilitates removal of the cable connector. Furthermore, the tap plug is retrofittable to existing copper and aluminum bushing rods, without any coordination for retrofitting.

Another principal feature of the invention is the provision of a tap plug comprising a housing, and a member which is rotatably supported by the housing, which is fixed against movement axially of the housing, and which includes means for threadedly engaging a bushing. The tap plug is preferably connected to a cable connector before the tap plug member is threadedly connected to the bushing. Because the member is fixed against movement in both directions axially of the housing, rotation of the member to engage the bushing causes both the tap plug and the cable connector to move onto the bushing. When the member is rotated to disengage the bushing, both the cable connector and the tap plug back off the bushing.

Another principal feature of the invention is a method for connecting a cable connector and a tap plug to a bushing.

Another principal feature of the invention is the provision of a coupling member for piloting the externally threaded portion of a tap plug into the internally threaded bore of a cable connector lug. This permits the operator to align the threads of the tap plug with the threads of the connector lug before the connector interferes with movement of the tap plug.

Another principal feature of the invention is the provision of frangible means, e.g., a shear pin, connecting the coupling member to the tap plug in order to obtain proper torquing of the tap plug into the connector lug.

Another principal feature of the invention is a method utilizing the above-described coupling member for connecting a tap plug to a cable connector.

Another principal feature of the invention is the provision of means for easily connecting either a bushing insert or a feedthrough device to a bushing well.

Other features and advantages of the invention will become apparent to those skilled in the art upon review of the following detailed description, claims and drawings.

Figures 1, 2, 3:
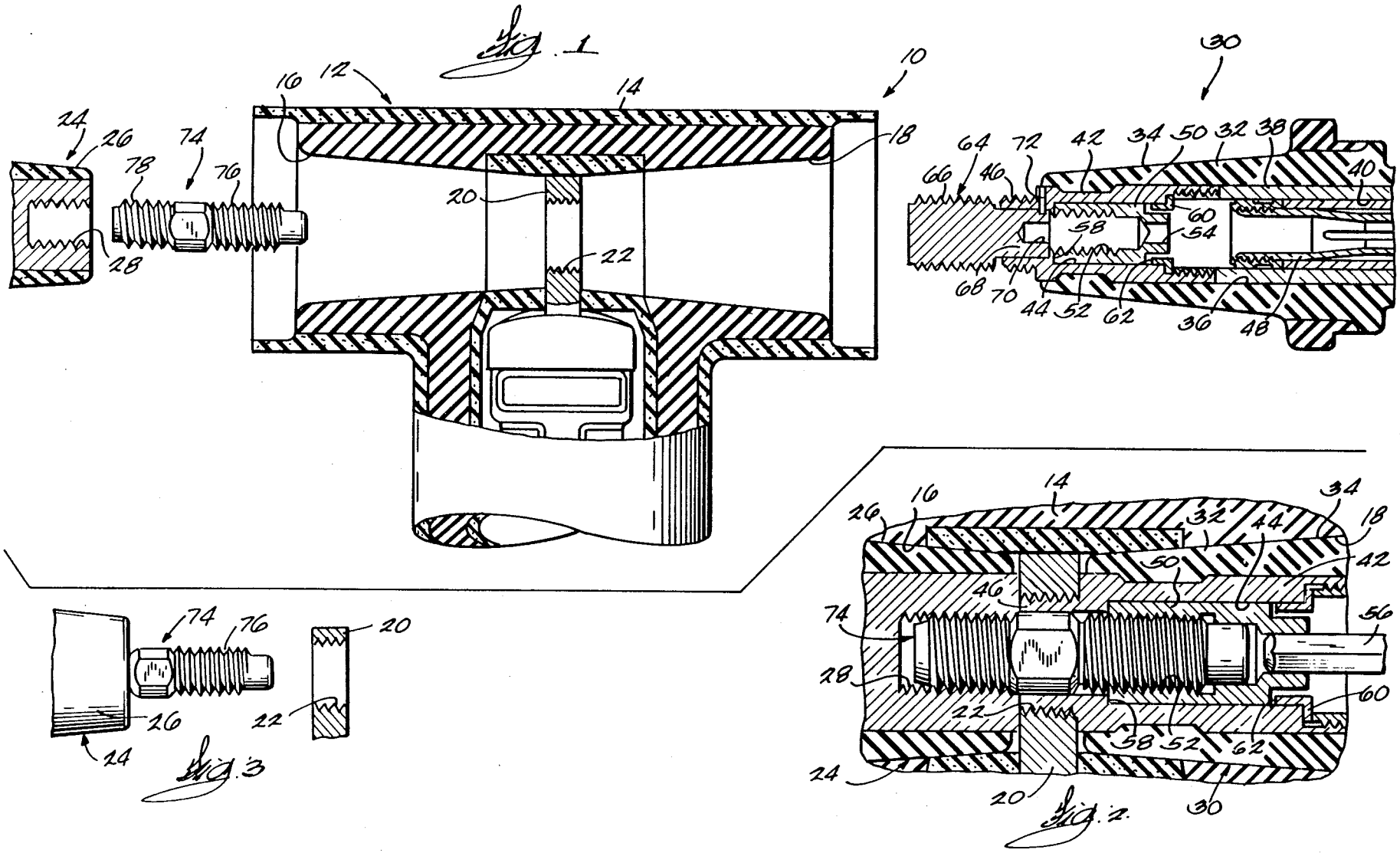
FIG. 1 is an exploded elevational view, partially in section, of a bushing, cable connector and tap plug assembly embodying the invention and comprising a bushing, a stud, a cable connector, a tap plug, and a coupling member.
FIG. 2 is an enlarged view, partially in section, of the assembly with the tap plug and cable connector connected to the bushing.
FIG. 3 is a partial view of the bushing, stud and cable connector with the stud threaded into the bushing.
Figure 4:
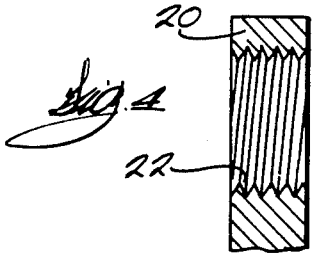
FIGS. 4–7 sequentially illustrate a method for threading the tap plug into the cable connector.

Before one embodiment of the invention is explained in detail, it is to be understood that the invention is not limited in its application to the details of construction and the arrangements of components set forth in the following description or illustrated in the drawings. The invention is capable of other embodiments and of being practiced or being carried out in various ways. Also, it is to be understood that the phraseology and terminology used herein is for the purpose of description and should not be regarded as limiting.

DESCRIPTION OF THE PREFERRED EMBODIMENT

An assembly 10 embodying the invention is illustrated in the drawings. As shown in FIG. 1, the assembly 10 comprises a T-shaped cable connector 12. The cable connector 12 includes a T-shaped housing 14 defining opposed, coaxial, tapered recesses 16 and 18. The connector 12 also incudes a lug or connector 20 which is connected to a high-voltage cable (not shown), which extends into the housing 14 between the recesses 16 and 18, and which has therethrough an internally threaded bore 22 coaxial with the recesses 16 and 18.

The assembly 10 also comprises a bushing 24 which is adapted to be connected to an electrical apparatus (not shown) such as a transformer. The bushing 24 includes a tapered outer surface 26 complementary with the recess 16, and the bushing 24 has therein an internally threaded bore 28 that is coaxial with the bore 22 in the lug 20 when the bushing 24 is housed in the recess 16.

The assembly 10 also comprises a loadbreak reducing tap plug 30. The tap plug 30 includes a housing 32 which has a tapered outer surface 34 complementary with the recess 18 and which has therein a bore 36 that is coaxial with the lug bore 22 when the tap plug 30 is housed in the recess 18. The tap plug 30 also includes an electrically conductive annular member or sleeve 38 housed in the bore 36 and having therethrough a bore 40, and an electrically conductive annular member or sleeve 42 which is housed in the bore 36, which is threadedly connected to the sleeve 38, which has therethrough a bore 44, and which has an externally threaded portion 46. The externally threaded portion 46 extends from the housing 32 and is adapted to be threaded into the lug bore 22.

The tap plug 30 also includes a contact assembly 48 which is slideably housed within the bore 40 and which is in electrical contact with the inner surface of the sleeve 38. The tap plug 30 also includes a "free-floating" nut or member 50 rotatably housed within the bore 44. The nut 50 has therein an internally threaded bore 52 and includes socket means 54 adapted to receive a tool or wrench 56 (FIG. 2) for rotating the nut 50. The tap plug 30 also includes means for preventing movement of the nut 50 axially of the housing 32. In other words, the nut 50 is fixed against movement in both directions axially of the housing 32. While various suitable means can be employed, in the preferred embodiment, this means includes, in the sleeve 42, a shoulder or stop 58 which prevents movement of the nut 50 to the left (as shown in FIG. 1) relative to the housing 32, and an annular member or ring 60 which is L-shaped in cross section, which is secured between the sleeves 38 and 42, and which provides, in the bore 44, a second shoulder or stop 62 that prevents movement of the nut 50 to the right (as shown in FIG. 1) relative to the housing 32. In alternative embodiments (not shown), the stop 62 can be replaced by a stop on the sleeve 38.

The assembly 10 also comprises means for facilitating threading of the externally threaded portion 46 into the lug bore 22, i.e., for aligning the threads of the externally threaded portion 46 with the threads of the lug bore 22. While various suitable means can be used, in the illustrated construction, this means includes a coupling member 64 including first and second portions 66 and 68, respectively. The first portion 66 is coaxial with the externally threaded portion 46 and has external threads that are substantially identical to and aligned with the threads on the externally threaded portion 46. Thus, the first portion 66 of the coupling member 64 and the externally threaded portion 46 can be threaded into the lug bore 22. The second portion 68 of the coupling member 64 is housed in the bore 44 in the externally threaded portion 46 and has therein socket means 70 adapted to receive the tool 56. The facilitating means also includes frangible means for preventing rotation of the coupling member 64 relative to the tap plug 30. In the preferred embodiment, the frangible means breaks when the coupling member 64 is rotated and the torque exerted on the externally threaded portion 46 of the tap plug 30 by the lug 22, which torque acts through the frangible means to resist rotation of the coupling member 64, reaches the desired level. This prevents "over-torquing" of the tap plug 30 and consequent damage to the threads of either the tap plug 30 or the lug 20. This also prevents "under-torquing" of the tap plug 30 and thus prevents a connection that is too loose. Preferably, the frangible means includes a shear pin 72 extending between the second portion 68 of the coupling member 64 and the externally threaded portion 46 of the tap plug 30.

The assembly 10 also comprises a stud 74 including externally threaded first and second or right and left ends 76 and 78, respectively. The first end 76 of the stud 74 is adapted to be threaded into the nut 50, and the second end 78 of the stud 74 is adapted to be threaded into the bushing bore 28.

Figure 5:
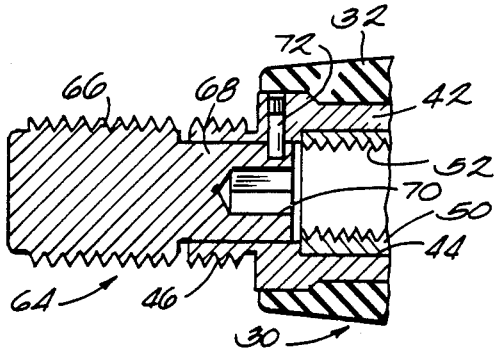
Figure 5:
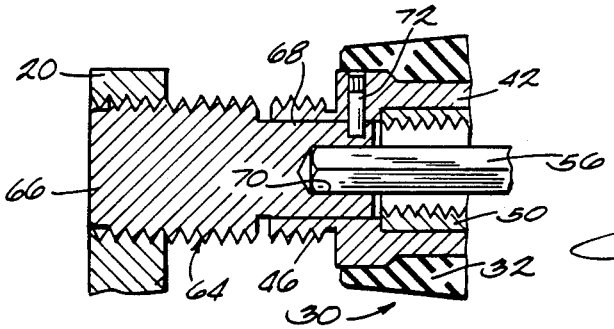
Figure 6:
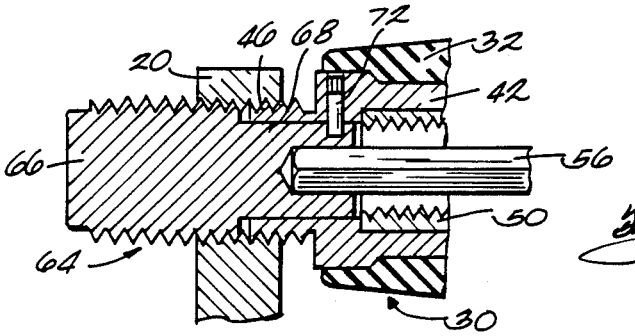
Figure 7:
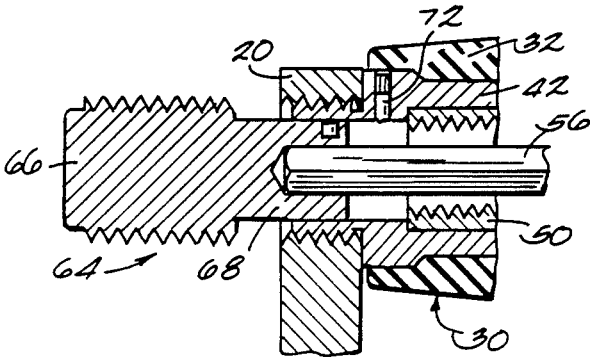

The preferred method for connecting the tap plug 30 to the cable connector 12, and then the cable connector 12 to the bushing 24 is illustrated in FIGS. 2–8. First, the externally threaded portion 46 of the tap plug 30 is turned or threaded into the lug bore 22 as shown in FIGS. 4–7. Using the wrench or tool 56 to rotate the coupling member 64 and the tap plug 30, the first portion 66 of the coupling member 64 is threaded into the lug 20, as shown in FIG. 5. Continued rotation of the coupling member 64 causes the externally threaded portion 46 of the tap plug 30 to be threaded into the lug 20, as shown in FIG. 6. Eventually, the torque exerted on the tap plug 30 by the cable connector lug 20 reaches the desired level and the shear pin 72 breaks, as shown in FIG. 7. The coupling member 64 is then removed from the externally threaded portion 46 of the tap plug 30 and from the cable connector housing 14.

Figure 8:
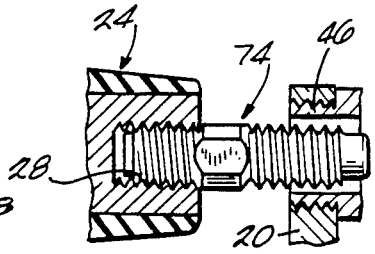
FIG. 8 is a view similar to FIG. 3 with the tap plug threaded into the cable connector.

Either before or after the above-described steps, the second end 78 of the stud 74 is threaded into the bushing bore 28. After the stud 74 is threaded into the bushing 24 and the externally threaded portion 46 is threaded into the lug 20, the cable connector housing 14 is placed over the bushing 24 so that the first end 76 of the stud 74 extends into the bore 44 in the externally threaded portion 46 of the tap plug 30, as shown in FIG. 8. Next, the wrench 56 is used to rotate the nut 50 and thereby thread the nut 50 onto the first end 76 of the stud 74, as shown in FIG. 2. Because the nut 50 is fixed axially of the tap plug 30, threading of the nut 50 onto the stud 74 causes both the tap plug 30 and the cable connector 12 to move toward the bushing 24, until the lug 20 engages the bushing 24.

Alternatively, the externally threaded portion 46 of the tap plug 30 can be threaded into the lug 20 without the assistance of the coupling member 64, although this can be difficult to do.

The cable connector 12 and tap plug 30 are disconnected from the bushing 24 by rotating the nut 50 in the opposite direction. Since the externally threaded portion 46 of the tap plug 30 remains threaded into the lug 20 and the nut 50 is fixed against movement axially of the tap plug 30, rotation of the nut 50 causes both the tap plug 30 and the cable connector 12 to back off the bushing 24 and the stud 74.

Figure 9:
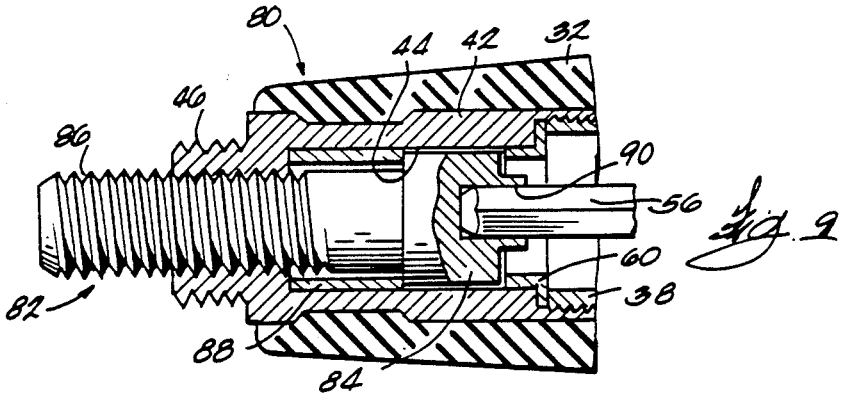
FIG. 9 is an elevational view, partially in section, of an alternative construction of the tap plug.

An alternative tap plug 80 is illustrated in FIG. 9. The alternative tap plug 80 is similar in many respects to the tap plug 30 of the preferred embodiment, and common elements have been given the same reference numerals.

Instead of the nut 50 of the preferred embodiment, the tap plug 80 includes a bolt 82 rotatably supported within the bore 44. The bolt 82 includes a head 84 rotatably housed in the bore 44, and an externally threaded portion 86 that extends outwardly of the externally threaded portion 46 of the tap plug 80. The head 84 is fixed against movement axially of the housing 32 by the ring 60 and by a bushing or sleeve 88 which is housed in the bore 44 and which engages the head 84 to prevent movement of the head 84 to the left as shown in FIG. 9. The head 84 includes socket means 90 adapted to receive the wrench 56.

The tap plug 80 is connected to the cable connector 12 by threading the externally threaded portion 46 of the tap plug 80 into the lug 20. Next, the bolt 82 is rotated with the wrench 56 to thread the bolt 82 into the bushing bore 22 and to thereby connect the tap plug 80 and cable connector 12 to the bushing 24. The cable connector 12 and tap plug 80 are disconnected from the bushing 24 by rotating the bolt 82 in the opposite direction. Because the bolt 82 is fixed axially of the tap plug 80, this causes both the tap plug 80 and the connector 12 to back off the bushing 24.

It should be understood that while the preferred embodiment of the invention is a tap plug, cable connector and bushing assembly, the invention can also be embodied in an assembly including a tap plug, a bushing and a connecting sleeve, i.e., a device which is similar to the cable connector 12 but which only connects a tap plug to a bushing and does not include a connection to a cable. The invention can also be embodied in an assembly including a tap plug, a cable connector and a dead-end plug (instead of the bushing 24), or in an assembly including just a tap plug and a cable connector.

Figure 10:
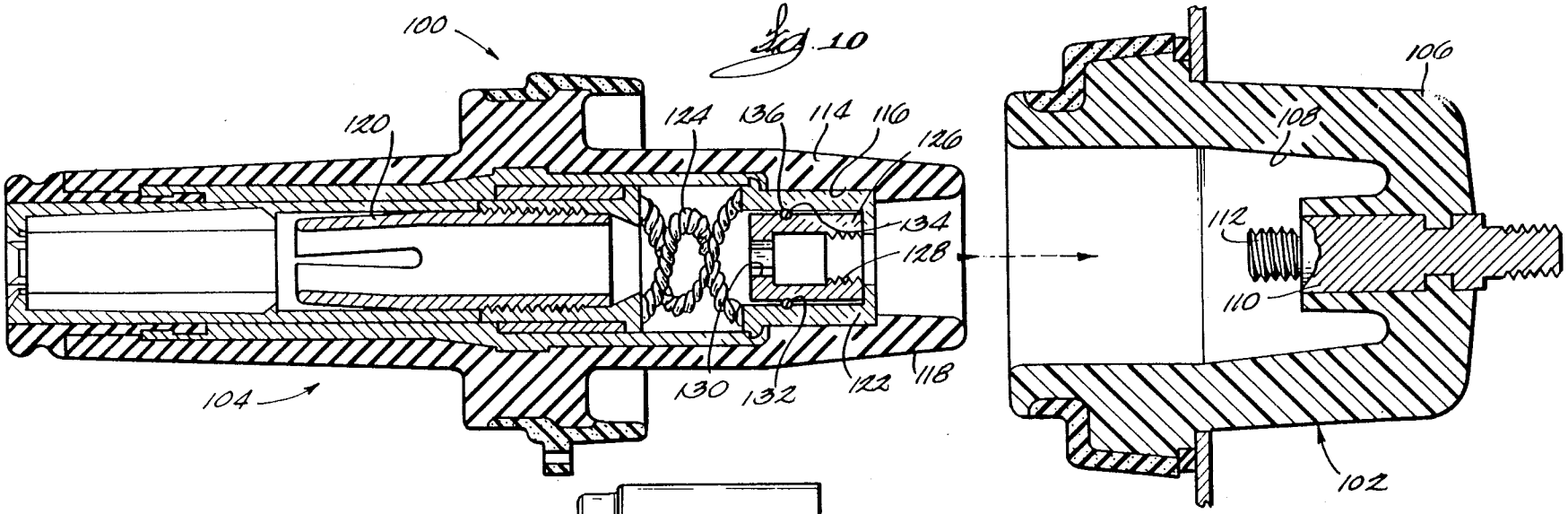
FIG. 10 is a view, partially in section, of a bushing well and insert assembly embodying the invention.

An assembly 100 which is an alternative embodiment of the invention is illustrated in FIG. 10. The assembly 100 includes a bushing well 102, and a bushing well insert 104.

The bushing well 102 is conventional and includes a well member 106 which has therein a recess 108, and a contact element 110 which is secured within the well member 106 and which has an externally threaded end 112.

The insert 104 includes a housing 114 having therein a bore 116 and having a tapered outer surface 118 complementary with the recess 108 in the well member 106. The insert 104 also includes a contact assembly 120, and a conductive annular member or sleeve 122 housed in the bore 116. The insert 104 further includes braided wire 124 electrically connecting the sleeve 122 and the contact assembly 120 and permitting axial movement of the contact assembly 120 relative to the sleeve 122.

The insert 104 also includes a free-floating nut 126 rotatably housed within the sleeve 122. The nut 126 has therein an internally threaded bore 128 and includes socket means 130 adapted to receive a tool or wrench (not shown) for rotating the nut 126. The insert 104 also includes means for preventing movement of the nut 126 axially of the housing 114. While various suitable means can be employed, in the illustrated construction, this means includes an annular groove 132 in the inner surface of the sleeve 122, an annular groove 134 in the outer surface of the nut 126, the grooves 132 and 134 being aligned, and an annular member 136 which extends into both grooves 132 and 134 to prevent relative axial movement of the nut 126 and the sleeve 122 and to permit relative rotation of the nut 126 and the sleeve 122.

The insert 104 and bushing well 102 are connected as follows. First, the insert 104 is inserted into the recess 108 in the bushing well 102 until the contact 110 engages the nut 126. Next, the wrench is used to rotate the nut 126 and therby thread the nut 126 onto the contact 110. Preferably, the wrench includes a depth gauge that insures that the insert 104 is fully inserted into the bushing well 102. Because the nut 126 is fixed axially of the insert 104, threading of the nut 126 onto the contact 110 causes the insert 104 to move toward the contact 110 and thus into the bushing well 102 until the contact 110 engages the sleeve 122. Since the nut 126 is rotated relative to the insert housing 114, there is no rotation of the insert housing 114 relative to the bushing well 102. Thus, it is not necessary to turn the insert 104 against the well 102.

The insert 104 and well 102 are disconnected by rotating the nut 126 in the opposite direction. Since the nut 126 is fixed against movement axially of the insert 104, rotation of the nut 126 causes the insert 104 to back off the bushing well 102.

Figure 11:
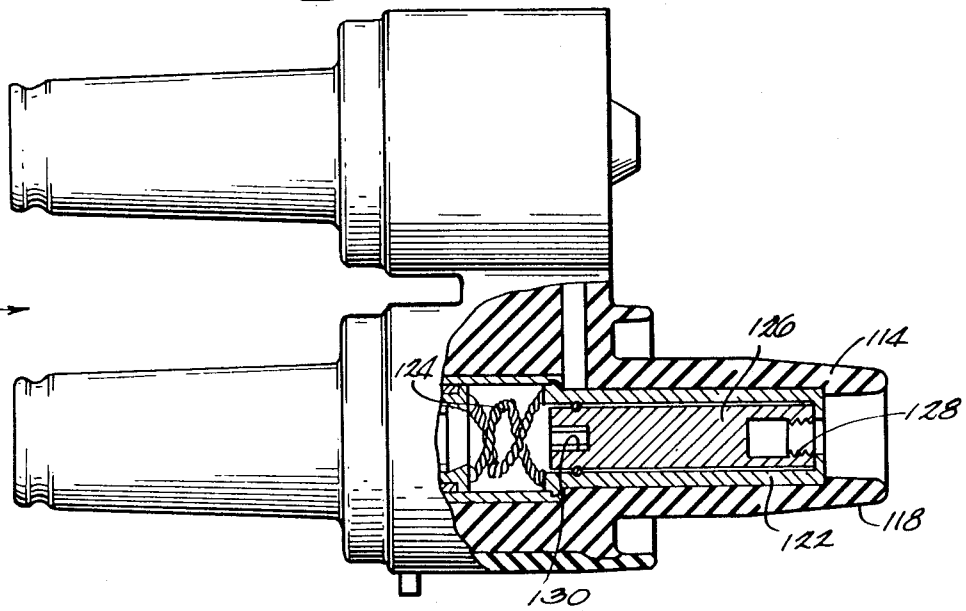
FIG. 11 is a view, partially in section, of a feedthrough device embodying the invention.

A feedthrough device 150 that is a second alternative embodiment of the invention is illustrated in FIG. 11. The feedthrough device 150 includes elements which are substantially identical to elements of the insert 104 and which have been given the same reference numerals. The main difference between the corresponding elements of the feedthrough device 150 and the insert 104 is that the nut 126 has a greater axial length. Like the insert 104, the feedthrough device 150 is adapted to be connected to a bushing well such as the bushing well 102 shown in FIG. 10.

Because the nut 126, rather than the entire feedthrough device 150, is threaded onto the contact 110 of the bushing well 102, the feedthrough device 150 can be placed in any rotational position relative to the bushing well 102. The feedthrough device 150 is simply placed in the desired position and then the nut 126 is threaded onto the contact 110 of the bushing well 102.

Various features of the invention are set forth in the following claims.

We claim:

1. An electrical device adapted to be connected to a conductive member, said device comprising a housing, a first member which is rotatably supported by said housing, which is fixed against movement in both directions axially of said housing, and which includes means for threadedly engaging the conductive member, and a second member which is supported by said housing and which includes an externally threaded portion extending from said housing and having therein a bore centered on an axis, said first member being supported by said second member for rotation about said axis and being fixed against movement axially of said second member.

2. A device as set forth in claim 1 wherein said bore has therein spaced-apart stops, and wherein said first member is located in said bore and between said stops.

3. A device as set forth in claim 1 wherein said first member is a nut having therein an internally threaded bore adapted to be threadedly connected to the conductive member.

4. A device as set forth in claim 3 wherein the conductive member has an externally threaded stud extending therefrom, and wherein said nut is adapted to engage the stud.

5. A device as set forth in claim 1 wherein said housing has therein an electrically conductive surface, and wherein said device further comprises a contact assembly located in contact with and movable relative to said conductive surface.

6. A method for connecting a first member to a second insulated, conductive member, said method comprising the steps of providing a connector having therethrough an internally threaded first bore, a first member having therein an internally threaded second bore, a second insulated, conductive member including a housing, an externally threaded portion extending from said housing and having therein a third bore, and a nut which includes an internally threaded fourth bore aligned with said third bore and which is supported by said housing and is rotatable relative to said housing, and a stud having externally threaded first and second ends, threading said first end of said stud into said second bore, threading said externally threaded portion of said second member into said first bore, and threading said second end of said stud into said fourth bore.

7. A method as set forth in claim 6 wherein said first and second threading steps are performed before said third threading step.

8. A method as set forth in claim 6 and further comprising the steps of providing a coupling member including a first portion which is coaxial with said externally threaded portion of said second member, which is externally threaded, and which is adapted to be threaded into said first bore, and also including a second portion housed in said third bore, and frangible means for preventing rotation of said coupling member relative to said second member, and wherein said step of threading said externally threaded portion of said second member into said first bore includes the steps of threading said first portion of said coupling member into said first bore until said externally threaded portion of said second member is aligned with said first bore, rotating said coupling member until said frangible means breaks to thread said externally threaded portion of said second member into said first bore, and removing said coupling member from said externally threaded portion of said second member and from said connector.

9. An electrical connector assembly comprising a first insulated, conductive member adpated to be connected to a connector having therein an internally threaded first bore, said first member including an externally threaded portion which is adapted to be threaded into the first bore and which has therein a second bore, and a coupling member including a first portion which is coaxial with said externally threaded portion of said first member, which is externally threaded and which is adapted to be threaded into the first bore, and including a second portion housed in said second bore.

10. An assembly as set forth in claim 9 and further comprising frangible means for preventing rotation of said coupling member relative to said first member.

11. An assembly as set forth in claim 10 wherein said frangible means includes a shear pin extending between said second portion of said coupling member and said externally threaded portion of said first member.

12. An assembly as set forth in claim 10 wherein threading of said externally threaded portion into the first bore creates a torque between said first member and the connector, and wherein said frangible means breaks when said coupling member is rotated and the above-mentioned torque reaches a predetermined level.

13. An assembly as set forth in claim 9 wherein said coupling member includes a socket adapted to receive a tool operable for rotating said coupling member.

14. A method for connecting an insulated, conductive member to a connector, said method comprising the steps of providing a connector having therein an internally threaded first bore, a first insulated, conductive member including an externally threaded portion which is adapted to be threaded into said first bore and which has therein a second bore, and a coupling member including a first portion which is coaxial with said externally threaded portion of said first member, which is externally threaded, and which is adapted to be threaded into said first bore, and a second portion of said coupling member housed in said second bore, threading said first portion of said coupling member into said first bore until said externally threaded portion of said first member is aligned with said first bore, and rotating said coupling member to thread said externally threaded portion of said first member into said first bore.

15. A method as set forth in claim 14 and further comprising the steps of providing frangible means for preventing rotation of said coupling member relative to said first member, rotating said coupling member until said frangible means breaks, and removing said coupling member from said externally threaded portion of said first member and from said connector.

16. An electrical connector assembly comprising a connector having therethrough an internally threaded first bore, a first member, and a second insulated, conductive member including a housing, an externally threaded portion of said second member threaded into said first bore, and a third member which is supported by said housing and is rotatable relative to said housing, which is fixed against movement in both directions axially of said housing, and which includes means for threadedly engaging said first member.

17. An assembly as set forth in claim 16 wherein said first member has therein an internally threaded second bore, wherein said third member is a nut, wherein said means includes, in said nut, an internally threaded third bore, and wherein said assembly further comprises a stud having a first end threaded into said second bore and a second end threaded into said third bore.

18. An electrical device adapted to be connected to a conductive member, said device comprising a housing, and a nut which is supported by said housing and is rotatable relative to said housing, which is fixed against movement in both directions axially of said housing, and which has therein an internally threaded bore adapted to be threadedly connected to the conductive member.

19. A device as set forth in claim 18 and further comprising a second member which is supported by said housing and which includes an externally threaded portion extending from said housing and having therein a bore centered on an axis, and wherein said nut is supported by said second member for rotation about said axis and is fixed against movement axially of said second member.

20. A device as set forth in claim 19 wherein said bore has therein spaced-apart stops, and wherein said nut is located in said bore and between said stops.

21. A device as set forth in claim 18 wherein the conductive member has an externally threaded stud extending therefrom, and wherein said nut is adapted to engage the stud.

22. A device as set forth in claim 18 wherein said housing has therein an electrically conductive surface, and wherein said device further comprises a contact assembly located in contact with and movable relative to said conductive surface.

23. An electrical apparatus comprising a tap plug adapted to be connected to a conductive member, said tap plug including a housing, and a nut which is supported by said housing and is rotatable relative to said housing, which is fixed against movement in both directions axially of said housing, and which has therein an internally threaded bore adapted to be threadedly connected to the conductive member.

24. An electrical apparatus as set forth in claim 23 and further comprising a bushing having therein an internally threaded bore, and said apparatus also comprising a stud including an externally threaded first end adapted to be threaded into said nut bore, and an externally threaded second end adapted to be threaded into said bushing bore.

25. An electrical apparatus as set forth in claim 24 and further comprising a cable connector including a housing defining opposed, coaxial recesses, and a lug extending into said cable connector housing between said recesses, wherein said bushing is housed in one of said recesses, wherein said tap plug is housed in the other of said recesses, and wherein said stud extends through said lug.

26. An electrical apparatus as set forth in claim 25 wherein said lug has therethrough an internally threaded bore which is coaxial with said recesses and through which said stud extends, and wherein said tap plug also includes an externally threaded portion threaded into said lug bore.

* * * * *